US007032268B2

(12) United States Patent
Jackson

(10) Patent No.: US 7,032,268 B2
(45) Date of Patent: Apr. 25, 2006

(54) BRIDGE OVERHANG BRACKET

(76) Inventor: George W. Jackson, 1535 Lakeshore Road East, Apartment 1107, Mississauga, Ontario (CA) L4E 3E2

( * ) Notice: Subject to any disclaimer, the term of this patent is extended or adjusted under 35 U.S.C. 154(b) by 0 days.

(21) Appl. No.: 10/743,751

(22) Filed: Dec. 24, 2003

(65) Prior Publication Data

US 2005/0071936 A1 Apr. 7, 2005

(30) Foreign Application Priority Data

Oct. 7, 2003 (CA) ..... 2,444,449

(51) Int. Cl.
*E01D 21/00* (2006.01)

(52) U.S. Cl. ..... 14/78; 248/242; 249/24

(58) Field of Classification Search ..... 248/242, 248/250; 249/24; 52/125.5; 14/78, 77.1, 14/73; 243/242–244
See application file for complete search history.

(56) References Cited

U.S. PATENT DOCUMENTS 1,965,686 A * 7/1934 Bruce ..... 249/24
2,195,579 A * 4/1940 Murdock ..... 248/242
2,414,538 A * 1/1947 Lamb ..... 182/113
3,776,498 A * 12/1973 Peters et al. ..... 248/219.1
3,806,074 A * 4/1974 Ward ..... 248/228.1
3,989,219 A * 11/1976 Pruett ..... 249/24
4,348,002 A * 9/1982 Eyden ..... 249/19
4,660,800 A * 4/1987 Horstketter ..... 249/24
5,318,148 A * 6/1994 Franco et al. ..... 182/45
5,755,981 A * 5/1998 Payne ..... 249/24
5,865,410 A * 2/1999 Horen ..... 248/242

OTHER PUBLICATIONS

Dayton Superior, "Bridge Deck Forming Handbook",1985, pp. 42-50.

* cited by examiner

*Primary Examiner*—Raymond W. Addie
(74) *Attorney, Agent, or Firm*—Bereskin & Parr

(57) ABSTRACT

A bridge overhang bracket includes an elongate top member having inner and outer ends an elongate diagonal member having an inner end and an outer end, the outer end of the diagonal member pivotally attached to the outer end of the top member, upper and lower pivot joints secured to the top member and diagonal member, respectively, adjacent the respective inner ends thereof, and an elongate side member extending between and engaged with the upper and lower pivot joints. At least one of the pivot joints comprises an adjustable axial engagement mechanism for adjusting the position along the length of the side member at which the at least one pivot joint engages the side member.

9 Claims, 7 Drawing Sheets

BRIDGE OVERHANG BRACKET

FIELD OF THE INVENTION

This invention relates to shoring devices, for example, brackets used for bridge overhangs.

BACKGROUND OF THE INVENTION

Bridges typically have decks that extend laterally outwardly beyond structures that support the decks. To construct such overhanging portions of the deck, a bridge overhang bracket is provided, having bracket members for transferring load from the deck overhang portion to the supporting structures.

Bridge overhang brackets may have three primary members, namely, a top (generally horizontal) member, a side (generally vertical) member, and a diagonal member. The three members (also referred to as legs) are bolted together near their ends to form a rigid triangle. The horizontal member is fitted with a bolt holder at a point in between the ends of the horizontal member. To use the bracket, it is placed against a beam, column or other part of the structure of a bridge being built. A bolt is placed through the bolt holder and attached to a hanger on the beam or column to hold the bracket up. The horizontal member extends generally horizontally from a proximal end abutting the beam or column to a distal end. The vertical member extends downwards from an upper end, attached to the proximal end of the horizontal member to a lower end that abuts against a lower part of the beam or column. The diagonal member is attached to and spans between the distal end of the horizontal member and the lower end of the vertical member. After several such brackets are placed along a beam or series of columns, joists or parts of formwork are laid across the horizontal members to provide a shored surface, such as a form for pouring a cantilevered portion, or overhang, of a concrete bridge deck.

SUMMARY OF THE INVENTION

It is an object of the invention to improve on the prior art. It is another object of the present invention to provide a bridge overhang bracket and elements of a bridge support system. These and other objects are provided by the features described in the claims. The following summary provides an introduction to the invention which may reside in a combination or sub-combination of features provided in this summary or in other parts of this document.

The invention provides a bridge overhang bracket that comprises a horizontal member, a diagonal member and a vertical member. The horizontal member has a distal end and a proximal end. The proximal end may be fitted with an abutment for bearing against a column, beam or other supporting structure. A bolt holder is attached to the horizontal member between its ends for attachment to a bolt or rod running to a hanger or other part of the supporting structure. The diagonal member is attached at one end, for example pivotably, to the distal end of the vertical member. A second end of the diagonal member may be fitted with another abutment for bearing against another part of the supporting structure. The vertical member is attached, for example pivotably, to the proximal end of the horizontal member and the second end of the diagonal member.

In one of its aspects, the invention provides a bracket in which a member, such as the vertical member, has a length between its points of attachment to the horizontal and diagonal members that is infinitely adjustable. Being infinitely adjustable, the length of the vertical member between its points of attachment can be tailored to a large variety of supporting structures, can accommodate for inconsistencies in the shape of the supporting structure, or to angle the horizontal member such that, when loaded, the horizontal member corresponds to a desired angle. In another aspect, the invention provides a bracket with a member, such as the vertical member, with a length between attachment points that can be altered without disassembling the bracket. In this way, the bracket may be more easily adjusted after it is installed against a supporting structure. In another aspect, the invention provides a bracket with a member, such as the vertical member, with a length between points of attachment that may be adjusted at or above the vertical member, for example by rotating the vertical member or by adjusting the attachment between the vertical and horizontal members. In this way, adjustments made after a bracket is installed against a supporting structure may be made from the top of the supporting structure. In another aspect, the invention provides a bracket with a vertical member that may slide in one of its points of attachment, for example its attachment with the vertical member. In this way, the bracket may be made foldable without requiring disassembly of the bracket.

Two or more of the aspects described above may be combined in various embodiments. In an exemplary embodiment, to be described in detail, all of these aspects are combined. In that embodiment, the vertical member is a threaded rod. The horizontal and diagonal members are fitted with pins that can pivot in holes in the horizontal and diagonal members. The vertical member passes through these holes. The ends of the vertical member extend beyond the pins and have nuts threaded onto them. When the horizontal and diagonal members are spread apart, the nuts on the vertical member bear against the pins so that the vertical member may be loaded in tension. Turning either of the nuts changes the length of the vertical member between the pins, allowing the bracket to be adjusted. The bracket can be folded by pivoting the horizontal and diagonal members together which causes the vertical member to slide through one or both pins.

Although the words "vertical" and "horizontal" are used in this document, the various members of the bracket may depart significantly from a strictly vertical or horizontal orientation. For example, the horizontal member may be angled upwards or downwards to comply with a sloping bottom surface of a bridge overhang. The vertical member may be angled towards or away from a beam or column as required to account for the shape of the beam or column or various locations of its attachment with the vertical member. Further, while each member has been described in the singular, each member may be made up of two or more individual pieces connected together. For example, a member may be made of two or more nesting channels or telescoping rods or tubes that may be bolted together to provide members having a set of possible lengths. Further, one or more of the members may be fitted with a series of holes such that other members or components can be attached to it at a variety of locations. Additional features may also be added to the bracket. For example, the distal end of the horizontal member may be fitted with a bracket to hold a guardrail or the vertical member may have channels to accept the heads of T-bolts or other fasteners.

BRIEF DESCRIPTION OF THE DRAWINGS

For a better understanding of the present invention and to show more clearly how it may be carried into effect, reference will now be made by way of example, to the accompanying drawings that show embodiments of the present invention, and in which.

DETAILED DESCRIPTION OF THE INVENTION

Figure 1:
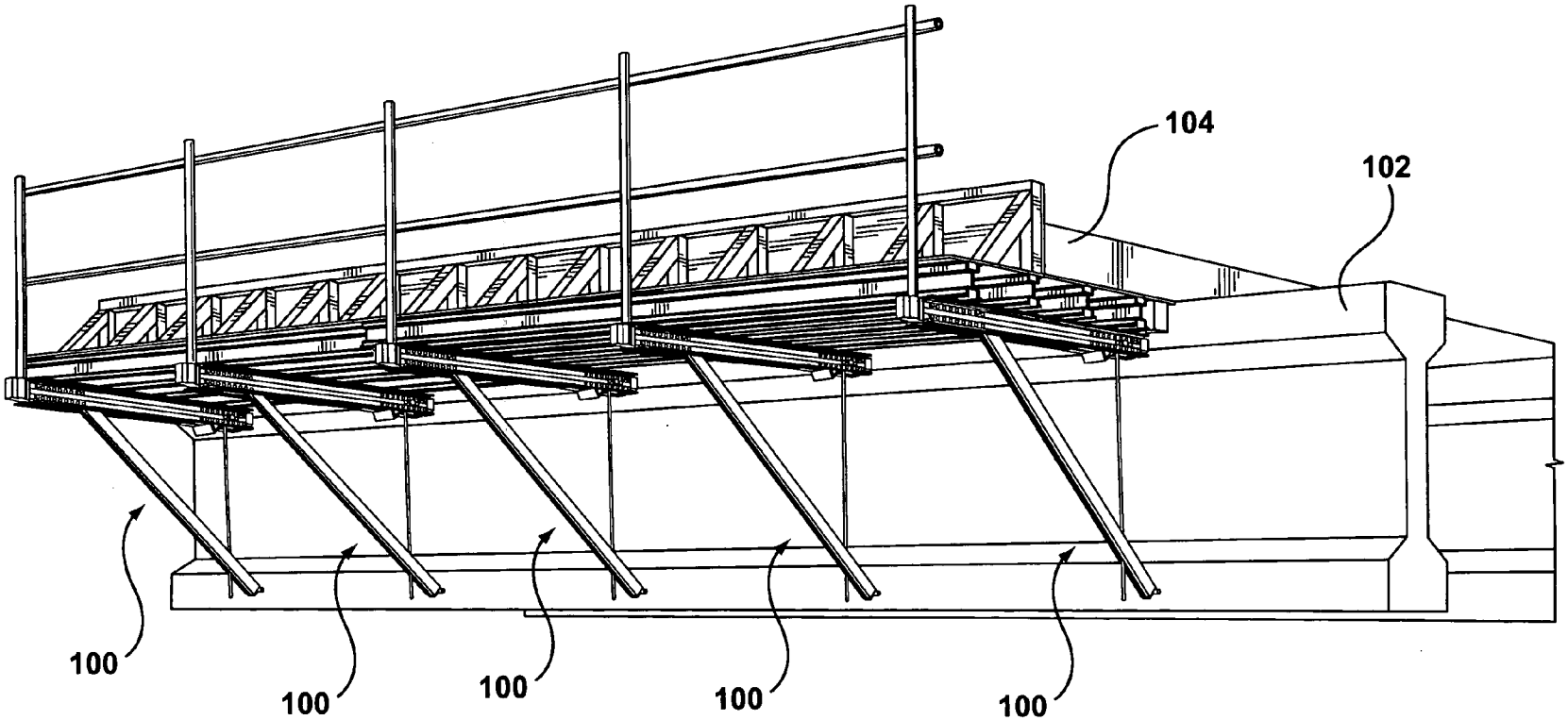
FIGS. 1 and 2 are perspective views of a plurality of bridge overhang brackets 100 according to the present invention shown in combination with a bridge support structure.
Figure 2:
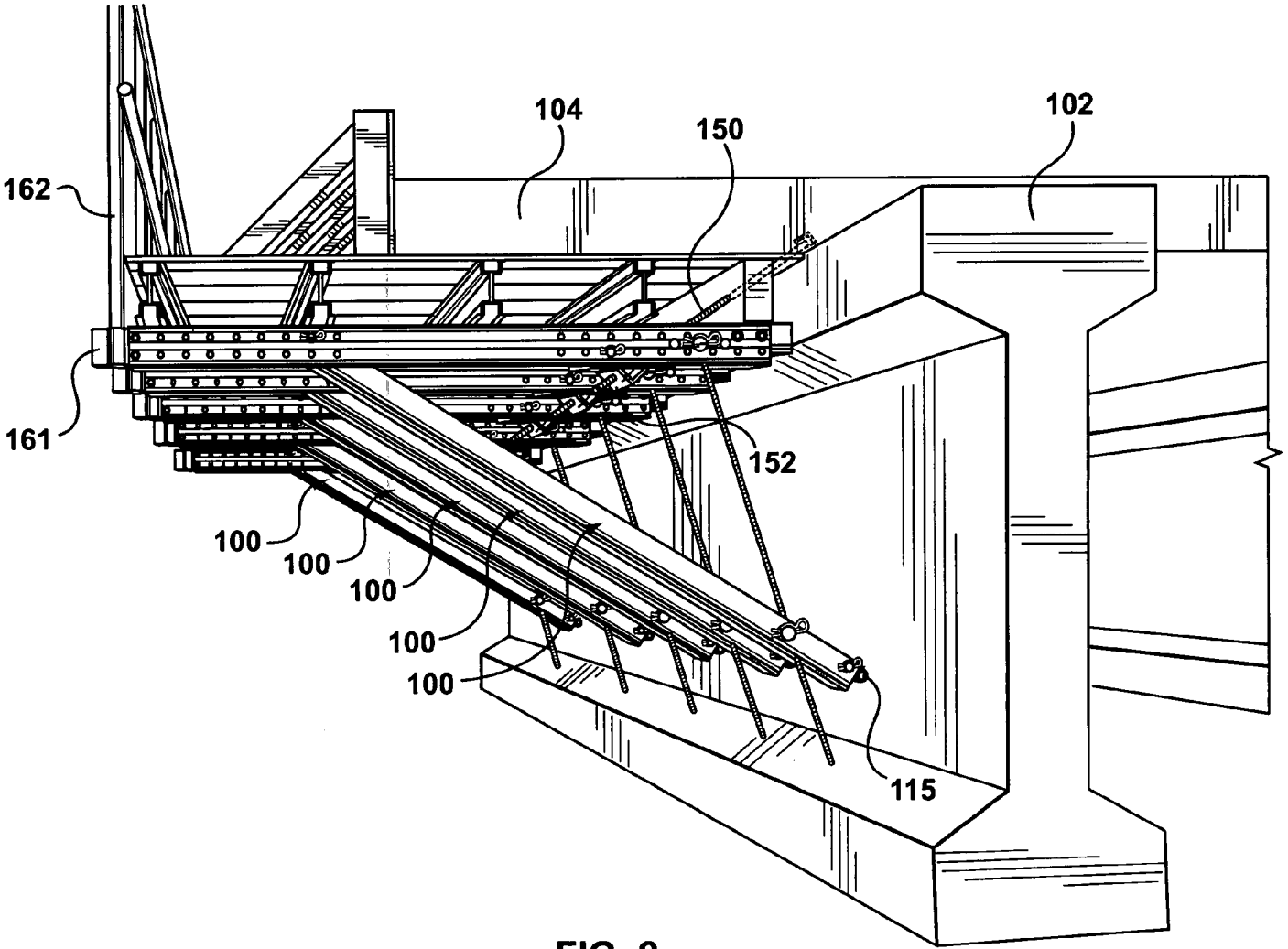

A bridge overhang bracket according to the present invention is shown generally at 100 in FIGS. 1 and 2. In FIGS. 1 and 2, about five brackets 100 are shown in combination with a concrete beam 102 for supporting a bridge deck 104.

Figure 3:
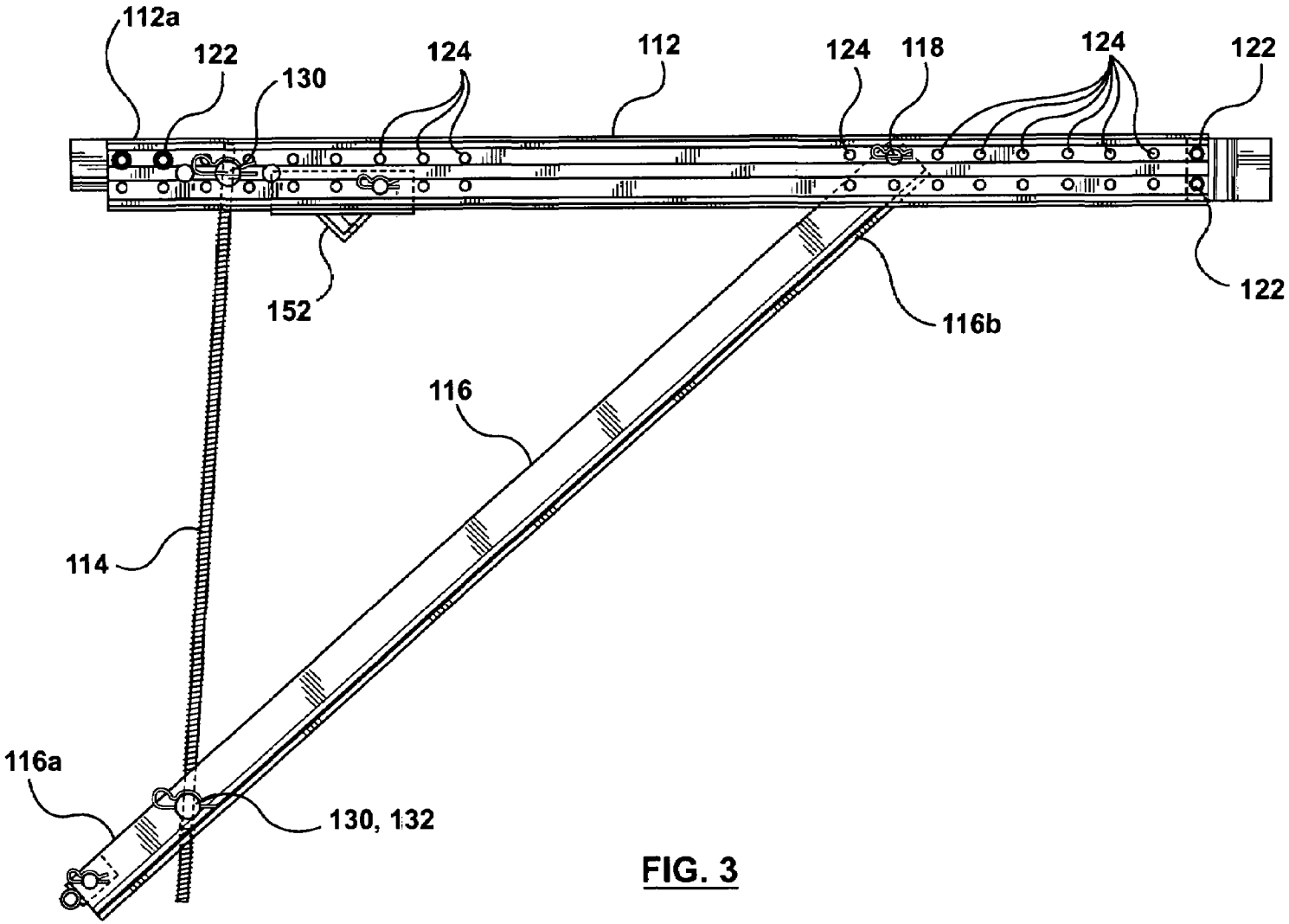
FIG. 3 is a side view of one of the brackets of FIG. 1.

Referring now to FIG. 3, the bracket 100 has three members, namely, a generally horizontal top member 112, a generally vertical side member 114, and a diagonal member 116 extending between the top and side members. The terms top, side, and diagonal are used to assist in describing the invention, and are not intended to be limiting. The top and side members may depart significantly from the horizontal and vertical, respectively.

The top member 112 has an inner end 112*a* and an outer end 112*b*. The diagonal member 116 also has inner and outer ends 116*a* and 116*b*, respectively. In use, (FIGS. 1 and 2) the inner ends 112*a* and 116*a* are nearest the beam 102 or other supporting structure, while the outer ends 112*b* and 116*b* are the outboard ends of the respective members 112 and 116, furthest from the beam 102.

Figure 4:
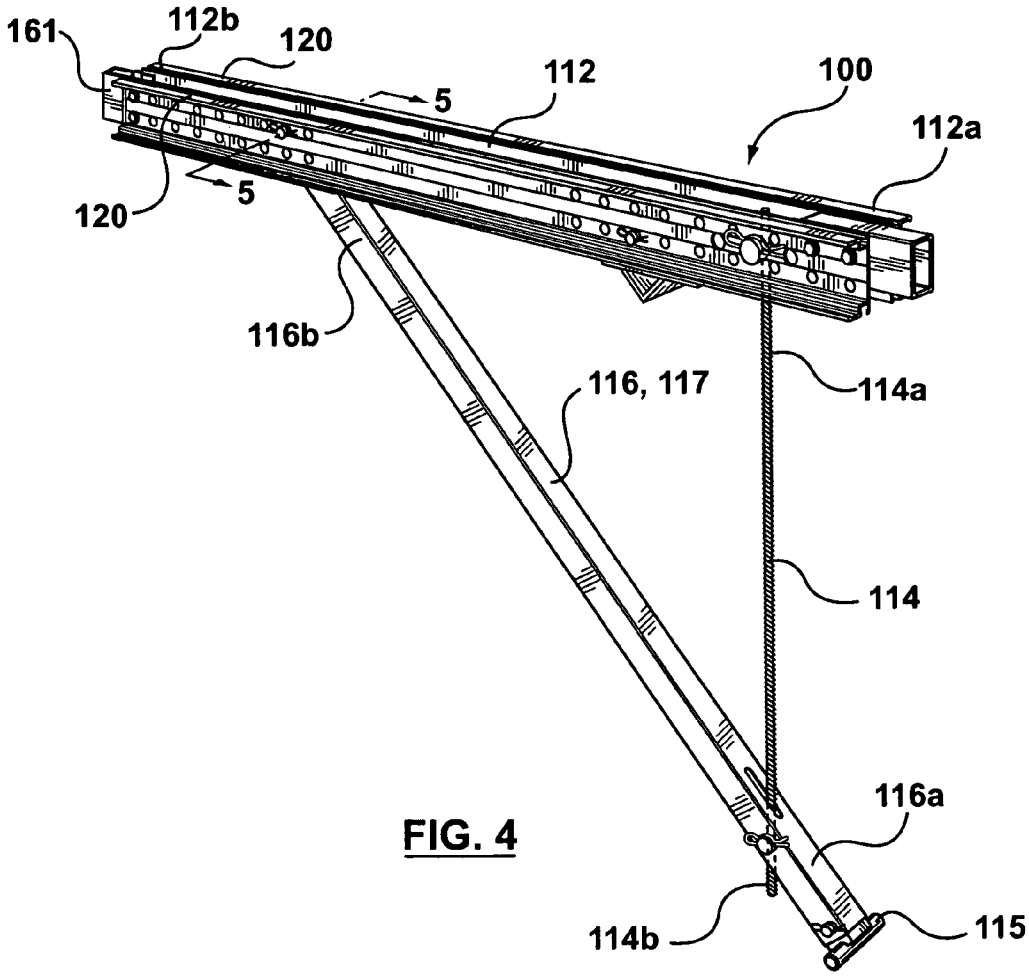
FIG. 4 is a perspective view of the bracket of FIG. 3.
Figure 5:
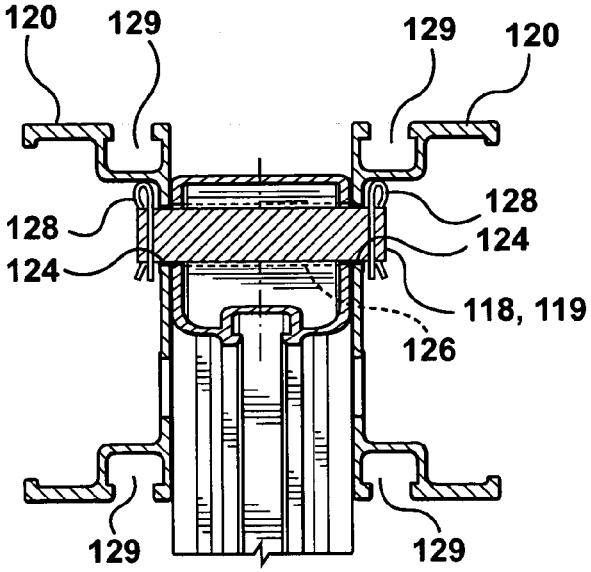
FIG. 5 is a cross-sectional view of a portion of the bracket of FIG. 4 taken along the lines 5—5.

A pivot joint 118 is provided adjacent the outer ends 112*b* and 116*b* for pivotally connecting together the top and diagonal members 112 and 116. As best seen in FIGS. 4 and 5, in the embodiment illustrated, the top member 112 comprises a pair of spaced-apart C-channel members 120 secured together by bolts 122. Aligned holes 124 are provided in the members 122. Nested lengths of C-channels 120 can be provided to form a telescoping top member 112 that can be lengthened or shortened as desired. T-bolt sub-channels 129 can be provided along the upper and lower surfaces of the C-channels 120 to facilitate connection to other scaffolding elements. The outer end 112*b* of the top member can be provided with a railing post receptacle 161 to support a railing 162 (FIGS. 4 and 2).

Figure 11:
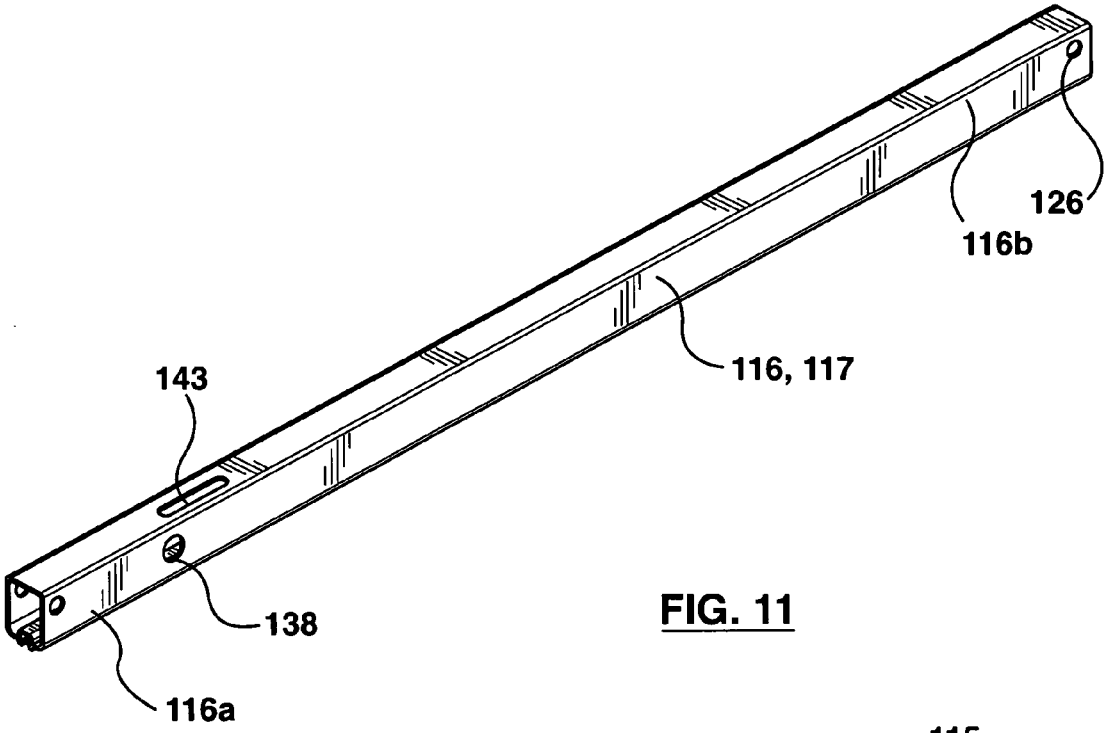
FIG. 11 is a perspective view of the diagonal member of the bracket of FIG. 3.
Figure 12:
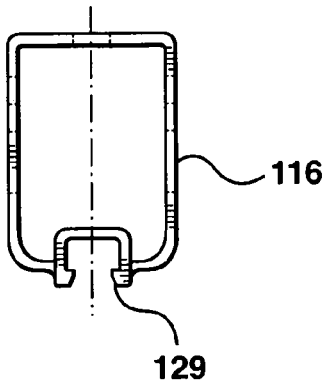
FIG. 12 is a cross-sectional view of the member of FIG. 11.
Figure 13:
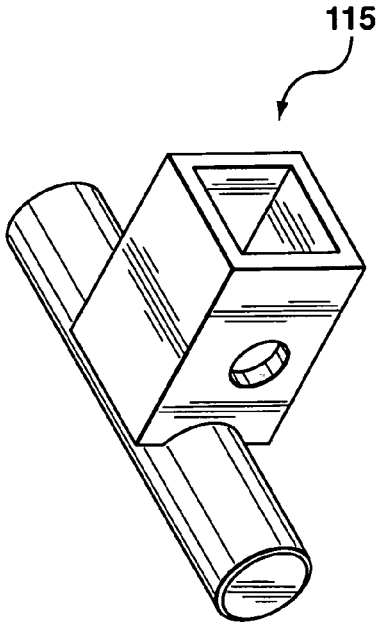
FIG. 13 is a perspective view of an end element for attachment to the member of FIG. 11.

As best seen in FIGS. 3, 11, and 12, the diagonal member 116 comprises a length of square channel 117, and a hole 126 is provided adjacent the outer end 116*b* of the member 116. The holes 126 can be aligned with a set of opposing holes 124 to receive a pivot pin 119 and thereby provide the pivot joint 118. Cotter pins 128 can be used to secure the pivot pin 119 (FIG. 5). An array of holes 124 can be provided along the length of the top member 112 adjacent the outer end 112*b*, so that the position of the pivot joint 118 can be incrementally adjusted along the length of the member 112 (FIG. 3). The lower surface of the diagonal member 116 can be provided a T-bolt sub-channel 129. An end cap 115 can be affixed to the inner end 116*a* of the diagonal member 116 to provide a sliding contact against the support structure 102 (FIGS. 4, 13, and 2).

Figure 6:
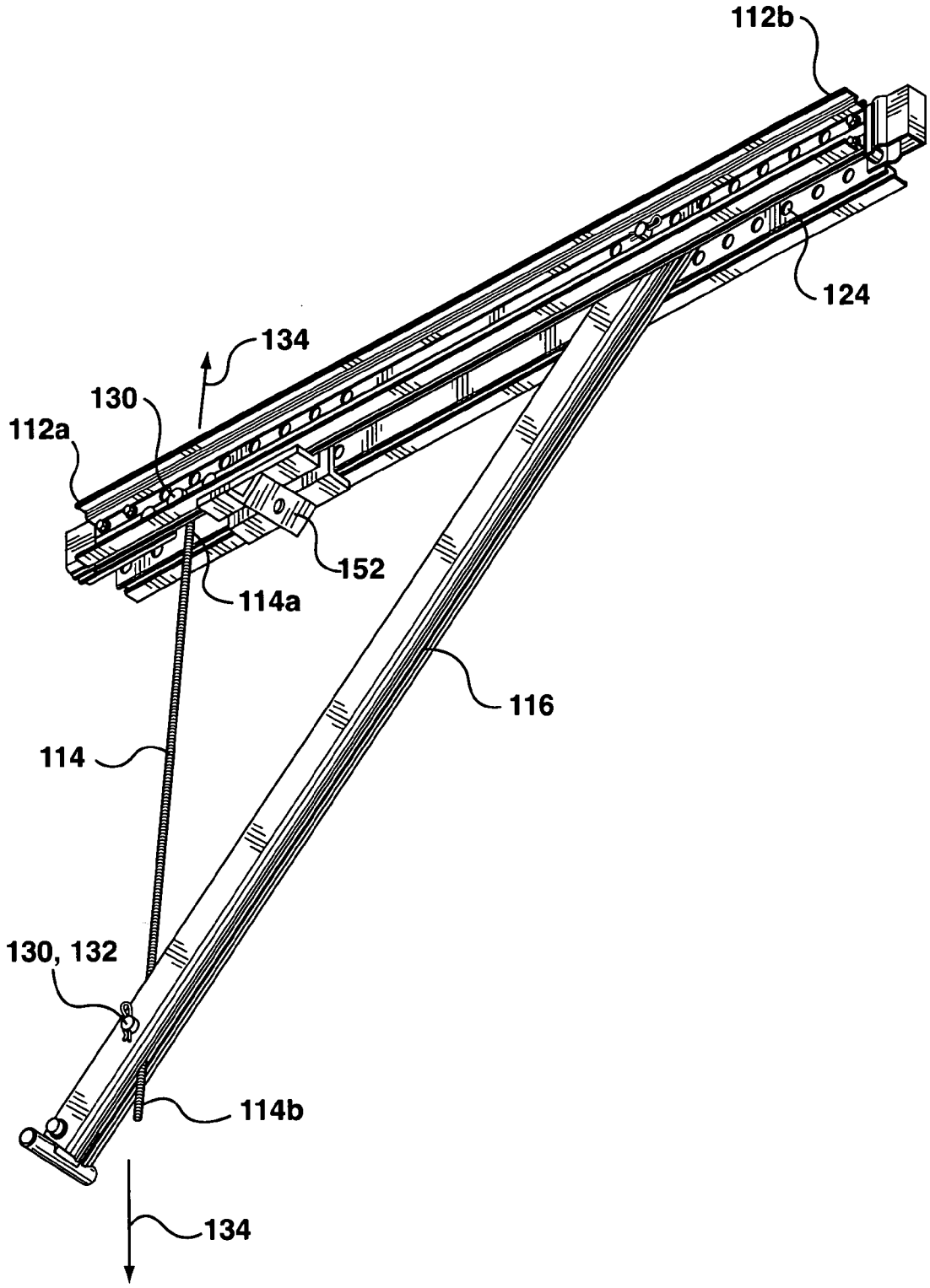
FIG. 6 is another perspective view of the bracket of FIG. 3.

Referring to FIG. 6, the side member 114 has upper and lower ends 114*a* and 114*b*, respectively, and extends between the top member 112 and the diagonal member 116. More specifically, pivot joints 130 are provided adjacent the inner ends 112*a* and 116*a* of the top and diagonal members 112 and 116, respectively, and the side member 114 extends between the pivot joints 130. In the embodiment illustrated, the side member 114 comprises a length of threaded rod.

According to the present invention, at least one of the pivot joints 130 comprises an adjustable pivot connector 132. The adjustable pivot connector 132 provides both a pivoting connection and an adjustable axial engagement mechanism 133 for adjusting, with infinite adjustability, the operative position of the connector 132 along the length of the side member 114. The term operative position is used because the side member 114 will generally be in tension when in use to support an overhanging portion of a bridge deck. In other words, the inner ends 112*a* and 116*a* of the upper and diagonal members 112 and 116 are urged apart from each other when under normal loads, as indicated by arrows 134. Accordingly, the position of the pivot joints 130, relative to the length of the side member 114, will be urged towards the distal upper and lower ends 114*a*, 114*b* of the side member 114. The adjustable axial engagement mechanism 133 need only restrain the connector 132 from moving outwardly relative to end of the side member 114.

Figure 7:
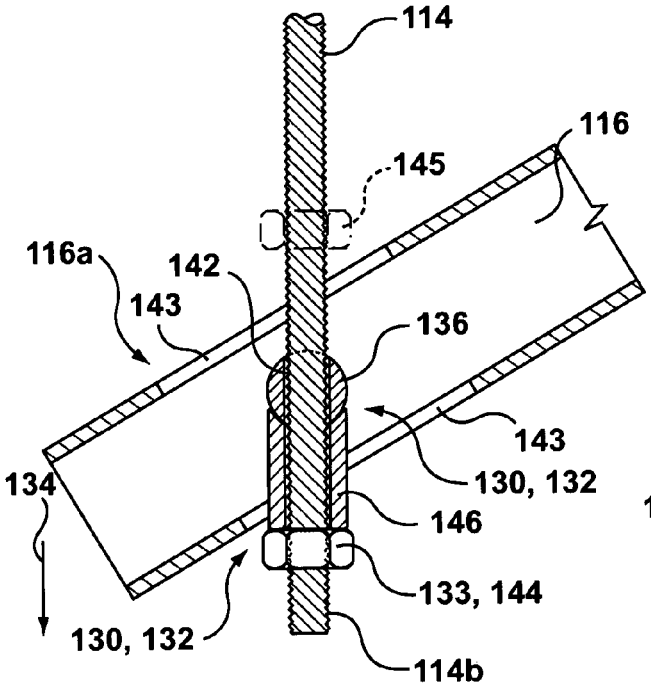
FIG. 7 is an enlarged side cross-sectional view of a portion of the bracket of FIG. 6.
Figure 8:
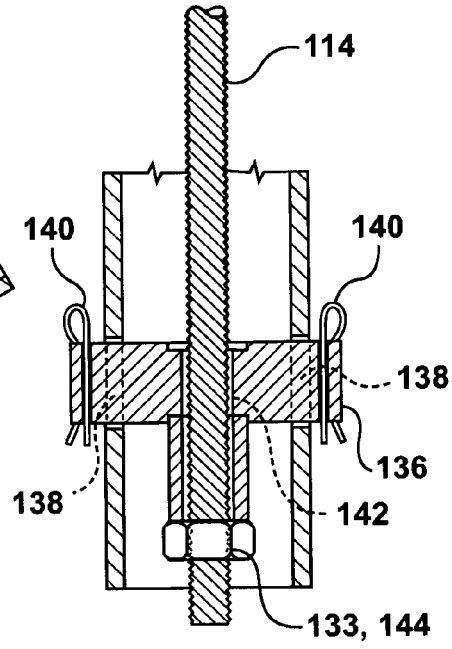
FIG. 8 is a front view of the portion of the bracket of FIG. 7.

Referring now to FIGS. 7 and 8, further details of an embodiment of the connector 132 will be described. The connector 132 comprises a pivot pin 136 that extends between generally horizontal, aligned holes 138 in opposed walls of the diagonal member 116, at a position adjacent the inner end 116*a*. The pivot pin 138 can be retained in position across the member 116 by cotter pins 140. The same structure can be used for providing the connector 132 at the upper pivot joint 130 in the top member 112.

Figure 9:
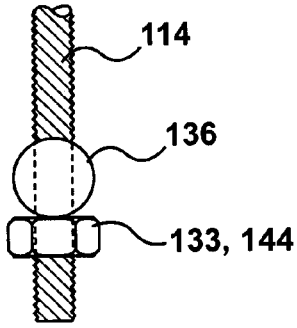
FIG. 9 is an alternate embodiment of a portion of the bracket of FIG. 7.

The pivot pin 136 has a cross bore 142 that is directed generally perpendicular to the axis of the pin 136, and positioned intermediately along the length of the pin 136. The cross bore 142 is sized to receive the side member 114 in sliding fit. An elongate slot 143 is provided in the upper and lower walls of the diagonal member 116 to accommodate the side member 114 and permit it to freely pivot about the pin 136. An adjustable axial engagement mechanism 133 in the form of a retaining nut 144 is threaded on to the threaded rod (side member) 114, between the pin 136 and the distal end (the lower end 114*b* in FIGS. 7 and 8) of the side member 114. An optional spacer 146 can be provided between the pin 136 and the retaining nut 144 to improve the bearing surface between the pin 136 and the nut 144, if desired. As seen in FIG. 9, the spacer 146 can be omitted so that the nut 144 abuts the outer surface of the pin 136. The slot 143 can be enlarged to permit access to the nut 144 with a gripping tool for turning the nut 144.

Figure 10:
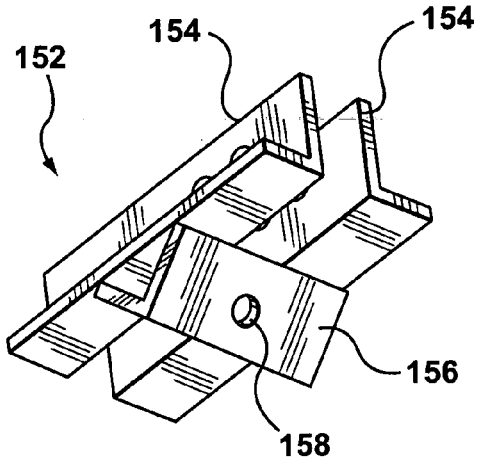
FIG. 10 is a perspective view of the hanger element of the bracket of FIG. 3.

In use, the bracket 100 can be assembled on the ground, using construction drawings to assemble the bracket 100 to an approximate shape. The bracket can then be hung from the support structure 102 by passing tie rods 150 extending from the structure 102 through a hanger 152 attached to the top member 112 (FIG. 2). As best seen in FIGS. 6 and 10, in the embodiment illustrated, the hanger 152 has a pair of spaced apart angle brackets 154 which are bolted to the underside of the top member 112, adjacent the inner end 112*a*. A connection bracket 156 is welded across the underside of the brackets 156. The connection bracket mounted to form a v-shape, and has an aperture 158 for receiving the tie rod 150.

Additional bridge overhang brackets 100 can be hung from the support structure 102 along the length of the bridge as required. Once the required number of brackets 100 have been hung, adjustments can be made to the connectors 132 to accommodate any variations encountered in the shape of the support structure or in the manufacturing and assembly tolerances of elements within the bracket 100 or any elements to which it is attached. The weight of the brackets 100, plus any formwork or railings that may be supported by the brackets 100 will generally urge the diagonal member 116 towards the distal (lower) end 114*b* of the side member 114. Accordingly, the pin 136 is urged towards the retaining nut 144. By turning the retaining nut 144, the (operative) position of the adjustable pivot connector 132 relative to the side member can be adjusted, without the need for partial disassembly of any of the brackets 100.

Referring again to FIG. 5, the nut 144 is provided only on the lower (outward) side of the pin 136, thereby restricting the pin 136 from moving outward, past the nut 144. The sliding fit between the side member 114 and the cross aperture 142 of the pin 136 can allow a pre-assembled bracket 100 to be conveniently collapsed at least to a certain degree by sliding the inner ends 112*a* and 116*a* towards each other (particularly in cases where both the upper and lower pivot joints 130 comprises the connectors 132). An optional nut 145 (shown in phantom in FIG. 7) can be provided above the pin 136 (opposite the nut 144), spaced apart from the pin 136 prior to installation of the bracket 100. The nut 145 can be tightened against the pin 136 after adjustment of the nut 144, so that the bracket 100 can withstand some light compression forces prior to pouring the bridge deck, such as from wind loads, which may otherwise cause some undesired movement of the bracket members.

While preferred embodiments of the invention have been described herein in detail, it is to be understood that this description is by way of example only, and is not intended to be limiting. The full scope of the invention is to be determined by reference to the appended claims.

The invention claimed is:

1. A bridge overhang bracket, comprising:

an elongate top member having inner and outer ends;

an elongate diagonal member having an inner end and an outer end, the outer end of the diagonal member pivotally attached to the outer end of the top member;

upper and lower pivot joints secured to the top member and diagonal member, respectively, adjacent the respective inner ends thereof; and, an elongate side member having a longitudinal axis and extending between and engaged with the upper and lower pivot joints;

wherein at least one of the pivot joints comprises an adjustable axial engagement mechanism for adjusting the position along the length of the side member at which the at least one pivot joint engages the side member, the adjustable axial engagement mechanism being adjustable by a user rotating the side member about the longitudinal axis.

2. The bracket according to claim 1 wherein the adjustable axial engagement mechanism comprises:

an upper thread engaging element engaged with the side member proximate the upper pivot joint;

a lower thread engaging element engaged with the side member proximate the lower pivot joint; and wherein the spacing between the lower thread engaging element and the lower pivot joint remains constant during rotation of the upper thread engaging element.

3. The bracket according to claim 1 wherein the side member comprises a threaded rod, and the axial engagement mechanism comprises a thread engaging element engaged with the threaded rod, and wherein adjustment of the axial engagement mechanism is by relative rotation of the threaded rod and the thread engaging element.

4. The bracket according to claim 1 wherein each of the upper and lower pivot joints comprises a pivot pin pivotally mounted about a generally horizontal axis in respective ones of the top and diagonal members.

5. The bracket according to claim 4 wherein each of the side member and the diagonal member comprise generally horizontal bores for receiving a respective one of the pivot pins in sliding fit.

6. The bracket according to claim 4 wherein each of the pivot pins comprise a generally vertical cross bore through which the side member extends.

7. The bracket according to claim 4 wherein each pivot pin of the upper and lower pivot joints comprises a generally vertical cross aperture for receiving the side member.

8. The bracket according to claim 7 wherein the side member comprises a threaded rod, and the adjustable axial engagement mechanism comprises a thread engaging member engaged with the threaded rod of the side member.

9. A bridge overhang bracket, comprising:

a top member having inner and outer ends;

a diagonal member having an inner end and an outer end, the outer end pivotally attached to the outer end of the top member;

upper and lower pivot joints secured to the top member and diagonal member, respectively adjacent the respective inner ends thereof; and a side member comprising a threaded rod extending between and engaged with the upper and lower pivot joints, wherein, at least one of the pivot joints comprises a thread engaging member engaged with the threaded rod such that the thread engaging member and threaded rod are rotatable relative to each other and rotation of one of the threaded rod or thread engaging member relative to the other moves the thread engaging member along the axial length of the threaded rod.

* * * * *